US008310171B2

(12) United States Patent
Reisenauer et al.

(10) Patent No.: US 8,310,171 B2
(45) Date of Patent: Nov. 13, 2012

(54) LINE VOLTAGE DIMMABLE CONSTANT CURRENT LED DRIVER

(75) Inventors: William Reisenauer, Commack, NY (US); Kevin Cannarili, Medford, NY (US); Stephen Sacks, Melville, NY (US)

(73) Assignee: LED Specialists Inc., Kings Park, NY (US)

( * ) Notice: Subject to any disclaimer, the term of this patent is extended or adjusted under 35 U.S.C. 154(b) by 557 days.

(21) Appl. No.: 12/546,886

(22) Filed: Aug. 25, 2009

(65) Prior Publication Data

US 2010/0231136 A1 Sep. 16, 2010

Related U.S. Application Data

(60) Provisional application No. 61/159,865, filed on Mar. 13, 2009.

(51) Int. Cl.
*H05B 41/16* (2006.01)
*H05B 41/24* (2006.01)

(52) U.S. Cl. ..... 315/287; 315/176; 315/308; 315/309

(58) Field of Classification Search ..... 315/276, 315/287, 291, 307–309
See application file for complete search history.

(56) References Cited

U.S. PATENT DOCUMENTS

| | | | | |
|---|---|---|---|---|
| 5,949,222 | A | 9/1999 | Buono | |
| 6,078,148 | A * | 6/2000 | Hochstein | 315/291 |
| 6,161,910 | A | 12/2000 | Reisenauer et al. | |
| 6,211,626 | B1 | 4/2001 | Lys et al. | |
| 6,239,585 | B1 | 5/2001 | Buono | |
| 6,441,558 | B1 * | 8/2002 | Muthu et al. | 315/149 |
| 6,693,394 | B1 | 2/2004 | Guo et al. | |
| 6,747,420 | B2 | 6/2004 | Barth et al. | |
| 6,922,022 | B2 | 7/2005 | Bucks et al. | |
| 7,019,662 | B2 | 3/2006 | Shackle | |
| 7,030,572 | B2 | 4/2006 | Nijhof et al. | |
| 7,132,805 | B2 | 11/2006 | Young | |
| 7,488,097 | B2 | 2/2009 | Reisenauer et al. | |
| 7,598,685 | B1 * | 10/2009 | Shteynberg et al. | 315/308 |
| 2003/0123521 | A1 | 7/2003 | Luoma | |
| 2006/0071806 | A1 | 4/2006 | Hollnberger et al. | |
| 2007/0242461 | A1 | 10/2007 | Reisenauer et al. | |

* cited by examiner

*Primary Examiner* — Jason M Crawford
(74) *Attorney, Agent, or Firm* — Gerald E. Hespos; Michael J. Porco

(57) ABSTRACT

A programmable LED constant current driver circuit for driving LEDs at constant current and dimming the LEDs using standard, off-the-shelf dimmers is provided. The current driver circuit of the present disclosure includes a temperature compensation feature which controls the on time for the LEDs based on a measured temperature of the current driver and associated circuits. In another embodiment, the current driver circuit is designed to receive a 24 VAC input and drive one or more LEDs in a transformer-based system dimming system.

7 Claims, 6 Drawing Sheets

Functional Block Diagram

Input 60Hz Waveform (Line Voltage)

Trailing Edge Electronic Low Voltage Dimmer (~50%)

Input Bridge/Rectifier

LINE VOLTAGE DIMMABLE CONSTANT CURRENT LED DRIVER

PRIORITY

This application claims priority to U.S. Provisional Patent Appl. No. 61/159,865, filed Mar. 13, 2009, the contents of which are hereby incorporated by reference in its entirety.

BACKGROUND

1. Field of the Invention

The present disclosure relates generally to lighting, light fixtures, lamp assemblies and LED lighting, and more particularly, to a programmable LED constant current drive circuit for driving LEDs at constant current and dimming the LEDs using standard, off-the-shelf, wall dimmers.

2. Description of the Related Art

Incandescent light bulbs are used in a large variety of lighting products. Although inexpensive to purchase, incandescent light bulbs have several drawbacks. First, incandescent light bulbs use a relatively large amount of power compared to other lighting products or technologies (e.g., light emitting diode (LED) or compact fluorescent lamp (CFL)) which increase energy costs. Second, incandescent light bulbs have a relatively short life causing repetitive replacement costs. Furthermore, since theses bulbs have a short life, labor costs in commercial applications will subsequently be effected by having maintenance personnel constantly replace the bulbs.

Because of their relatively low efficiency in generating light (95% or more energy is actually turned into heat with only 5% producing light), incandescent bulbs are actually being banned through government regulations at local and federal levels, in several countries around the world. In addition, states such as California have established regulations for new building construction (i.e., Title 24 for commercial and residential buildings) that require minimum levels of lighting energy efficiency which essentially prohibits incandescent bulbs from being used in any large quantity within a building.

Compact fluorescent light (CFL) bulbs, while offering 2-3 times the energy efficiency over incandescent light bulbs, due to their design and light emission properties, can pose limitations in overall efficacy when combined with a light fixture. In addition, CFL bulbs contain mercury (a long term environmental issue), are often slow to warm up to produce rated light levels and are generally not dimmable. CFL bulbs have received mixed reviews from consumers (e.g., aesthetic appearance, light color, noise), though the technology has continued to improve.

A recent trend in the lighting industry is to develop light emitting diode (LED) engines or modules that can be easily adapted to current light fixture products. LED technology offers 3-5 times the energy efficacy of traditional incandescent bulbs and has 25 times the reliability. This offers a potentially large savings in energy consumption in interior and exterior lighting applications. In addition, LEDs produce light which is more "directional", enabling LED light engine designers to customize the luminous intensity profile for various applications, further enhancing overall light fixture efficacy. While LED technology is generally more expensive, there can be substantial savings in energy cost, bulb replacement and maintenance costs over a multi-year period.

To-date, a number of "socket based" LED products have entered the market to retrofit in place of incandescent bulbs. Some of these products use a large number of lower power LEDs or a fewer number of high power LEDs. Generally, these products have had relatively low light output to replace common light fixture incandescent sources (e.g. 75 W bulb) and poor thermal management properties required to ensure long LED life. In addition, many of these light sources are highly directional and not compatible with many decorative light fixtures (e.g. pendants) detracting from the aesthetic appearance of the fixture and the LED light source.

Thus, a need exists for new LED based light fixtures and LED retrofit lighting products having low power consumption, high light output and effective means for heat dissipation when used within semi-enclosed light fixture products. The retrofit product should be a screw-in replacement for an incandescent or CFL bulb for easy retrofit into the existing installed base of light fixtures in residential and commercial applications. The light engine should convert standard residential and commercial line voltage to a form to drive the LEDs consistently and reliably.

LED systems are increasingly attractive for low voltage applications to replace incandescent and halogen based lamp systems to greatly improve lighting efficiency and reliability. Two examples where LEDs offer great benefits over traditional lighting technologies are in low voltage "track" lighting systems and "under-cabinet" lighting, though there are many other applications, including landscape lighting and cabinet interior lighting. In many of these applications, a range of dimmability is highly desirable to control the lighting intensity in the given installation.

With these systems, a standard magnetic or electronic transformer is typically employed to reduce the input line voltage (e.g., 100-240 VAC) to 12 VAC or 24 VAC. These transformers are attractive because they traditionally support incandescent based low voltage lighting and have a wide range of sources, are produced in high volume and are relatively low in cost. 24 VAC or 12 VAC is used to simplify the fixture, track and wiring system (2 wires) for low cost, flexibility and safety.

In these new LED systems, it is highly desirable to use existing solid-state dimmer technology that has evolved for incandescent lighting over the years to leverage the large installed base of dimmers and their relatively low cost. These "forward phase" dimmers work by varying the "duty cycle" (on/off time) of the input line AC waveform, to effectively control the average voltage over its normal cycle (e.g. 60 Hz). Typical dimmers use thyristors (e.g., Triacs) to switch the power, the timing for which is triggered at the zero crossing of the input power waveform and the dimmer setting (i.e., resistance). Special versions of these dimmers (Magnetic Low Voltage (MLV)) are available to support inductive loads (e.g. magnetic transformers). These dimmers have separate control electronics connected to both the live and neutral wire to better control the Triac switching.

Another type of dimmer, commonplace today, is an Electronic Low Voltage (ELV) dimmer that is based on a transistor design and provides "reverse-phase" or "trailing edge" dimming which is more compatible with the electronic transformer's reactive circuit. This type of dimmer will conduct power at the zero crossing point and then turn off at the adjustable position in the middle of the AC current phase.

The objective of a low voltage dimmable LED system is a good range of dimming (e.g. 10% to 100%), linear operation (i.e., light intensity decreases linearly with dimmer control movement) and no visible flickering effects (that can occur when phase-to-phase (60 hz) performance differences occur). Therefore, a need exists for techniques for dimming LED light engines and LED lighting systems, using standard phase control dimmer technology that is in use today for incandescent lighting and low voltage lighting.

Furthermore, it is difficult to control legacy light fixtures into which users will install these LED light engines. Generally, LED light engines have heat sinks that require cooling via convective means or they can overheat and not perform to their design specifications for light output, efficacy or service life. Therefore, a need exists for a temperature compensated LED driver that can adapt to it's installed environment.

SUMMARY

The present disclosure relates generally to light bulbs, lamp assemblies and lighting fixtures, and more particularly, to a light emitting diode (LED) based light engines and systems. The present disclosure provides a small, high efficiency line voltage (e.g. 115 VAC/220 VAC) LED driver that can provide constant current to 1 or more LEDs and also be compatible with a standard off-the-shelf phase control type dimmers. These dimmers were originally designed to support incandescent bulbs or electronic transformers. Therefore, embodiments of the present disclosure consider limitations of these transformers (e.g. minimum load) to have an LED dimming system that works reliably with varying amounts of light engines in the circuit and providing linear operation without perceptible flicker.

A programmable and compact line voltage (e.g. 115/220 VAC) powered LED driver circuit that provides constant current to at least one LED and is dimmable using standard off-the-shelf dimmers, such as for example Lutron Skylark ELV or Leviton Decora ELV dimmers, is provided. The driver circuit of the present disclosure is designed to be integrated into a range of LED light engines using one or more high power (>1 Watt) LEDs. In one embodiment, the drive circuit can drive 12 Watts of LED power (350 mA to 1 A of LED drive current), however higher or lower power variations are possible.

According to one aspect of the present disclosure, the driver circuit uses parts that allow for a compact form factor that can be easily integrated into a range of LED light engines. The driver circuit is designed for high Power Factor (>0.7) and efficiency of greater than 75%.

The present embodiment is designed to support "trailing edge" phase control dimmers such as Electronic Low Voltage (ELV) types, but can be adapted to leading edge phase control dimmers also.

The driver circuit of the present disclosure uses a microcontroller to monitor the input power waveform to activate the LED output current when sufficient energy is available and to shut down the LED drive otherwise. This process follows the input power frequency of approximately 120 hz (rectified 60 Hz waveform). The microcontroller ensures that a load exists on the external dimmer when it is turning the driver off to aid the dimmer in operating consistently to avoid flicker and other performance issues. Thus, linear LED dimming is provided through pulse modulation of the LED current at the input waveform frequency. The microcontroller allows for future software programming adjustments to accommodate other types of dimmers and light engines.

Since the LED current driver is only on when there is enough energy on the input lines, large capacitors or other energy storage devices are not required. This saves on size and current draw is mostly in phase with input voltage thus reducing power factor issues (current embodiment has PF>0.70).

In one embodiment, the LED current driver incorporates a temperature compensation feature to control the LED engine power in relation to engine temperature to ensure it does not heat up beyond its design case temperature. In this embodiment, the LED current driver includes a temperature sensor that provides a real-time analog printed circuit board (PCB) temperature reading to the microprocessor. Depending on the host light engine design and light fixture application, the microprocessor can be programmed to reduce LED on time (i.e., effective power) in proportion to temperature. This enables the light engine to stay within its temperature design parameters to ensure long, reliable service life.

The various embodiments disclosed incorporate a fuse for increased safety, has a transient suppression device to suppress incoming voltage spikes and EMI filtering to support FCC Class A and B requirements when properly integrated into a host LED engine.

In another aspect of the present disclosure, the current driver circuit is designed to receive a 24 VAC input and drive one or more LEDs in a transformer-based system and/or off-the-shelf Magnetic Low Voltage (MLV) and Electronic Low Voltage (ELV) dimming systems. In this embodiment, the current driver circuit supports a large range of dimming (10% to 100%) while providing linear light output adjustments and no perceptible flickering. During the "on" periods of duty cycle, the current driver circuit provides constant current to the LEDs to ensure consistent LED operation. The current driver may be used individually in an LED system or in combination with multiple driver/LEDs connected to the same dimmer and transformer. A three position switch is provided to set the overall power to a predetermined level, e.g., 6 W, 8 W or 10 W power levels, by changing the current value used to drive LED.

BRIEF DESCRIPTION OF THE DRAWINGS

The above and other aspects, features, and advantages of the present disclosure will become more apparent in light of the following detailed description when taken in conjunction with the accompanying drawings in which.

DETAILED DESCRIPTION

Preferred embodiments of the present disclosure will be described hereinbelow with reference to the accompanying drawings. In the following description, well-known functions or constructions are not described in detail to avoid obscuring the invention in unnecessary detail.

Figure 1:
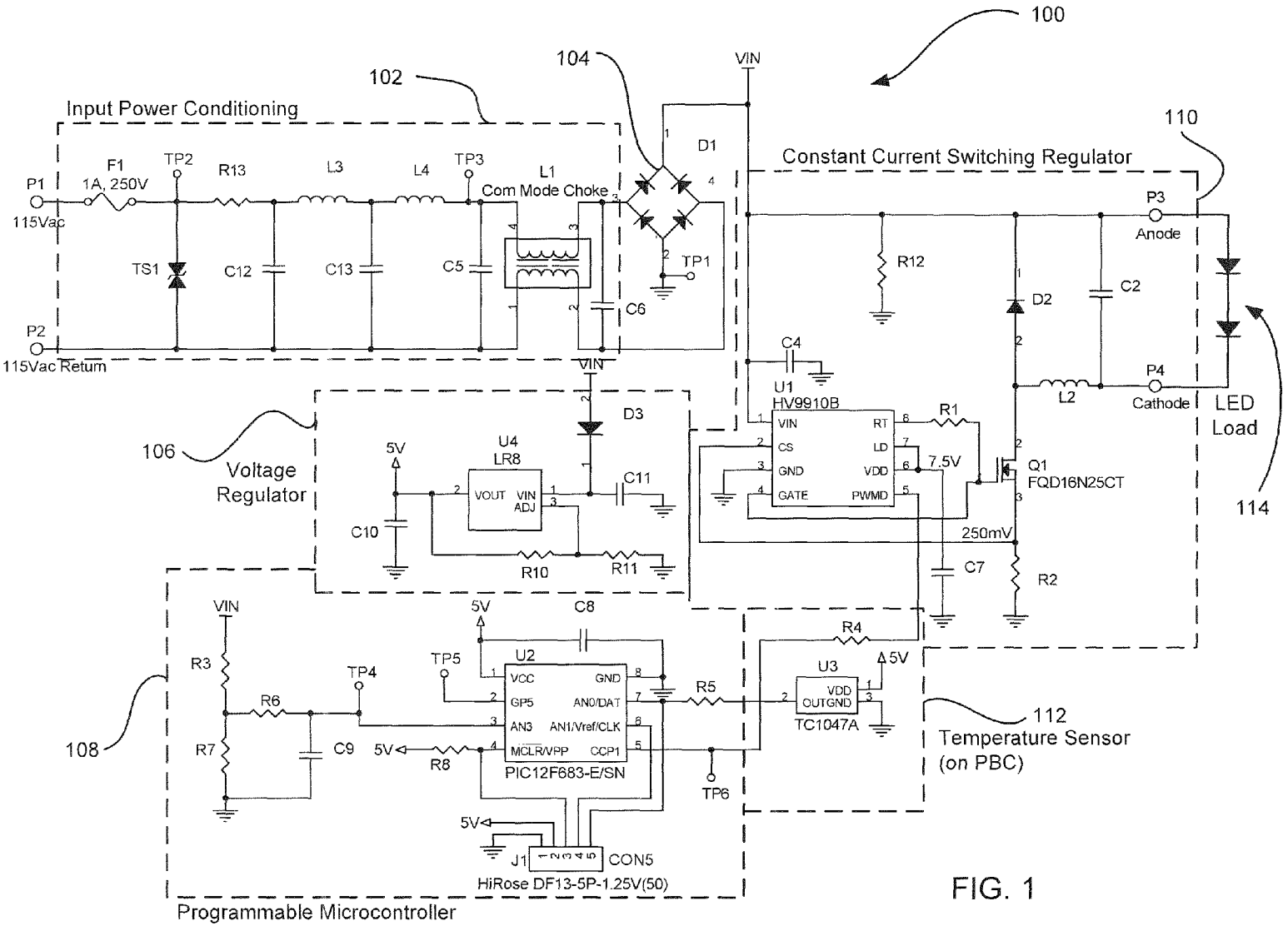
FIG. 1 is a schematic diagram of a dimmable LED driver segmented into its major functional blocks in accordance with the present disclosure.
Figure 2:
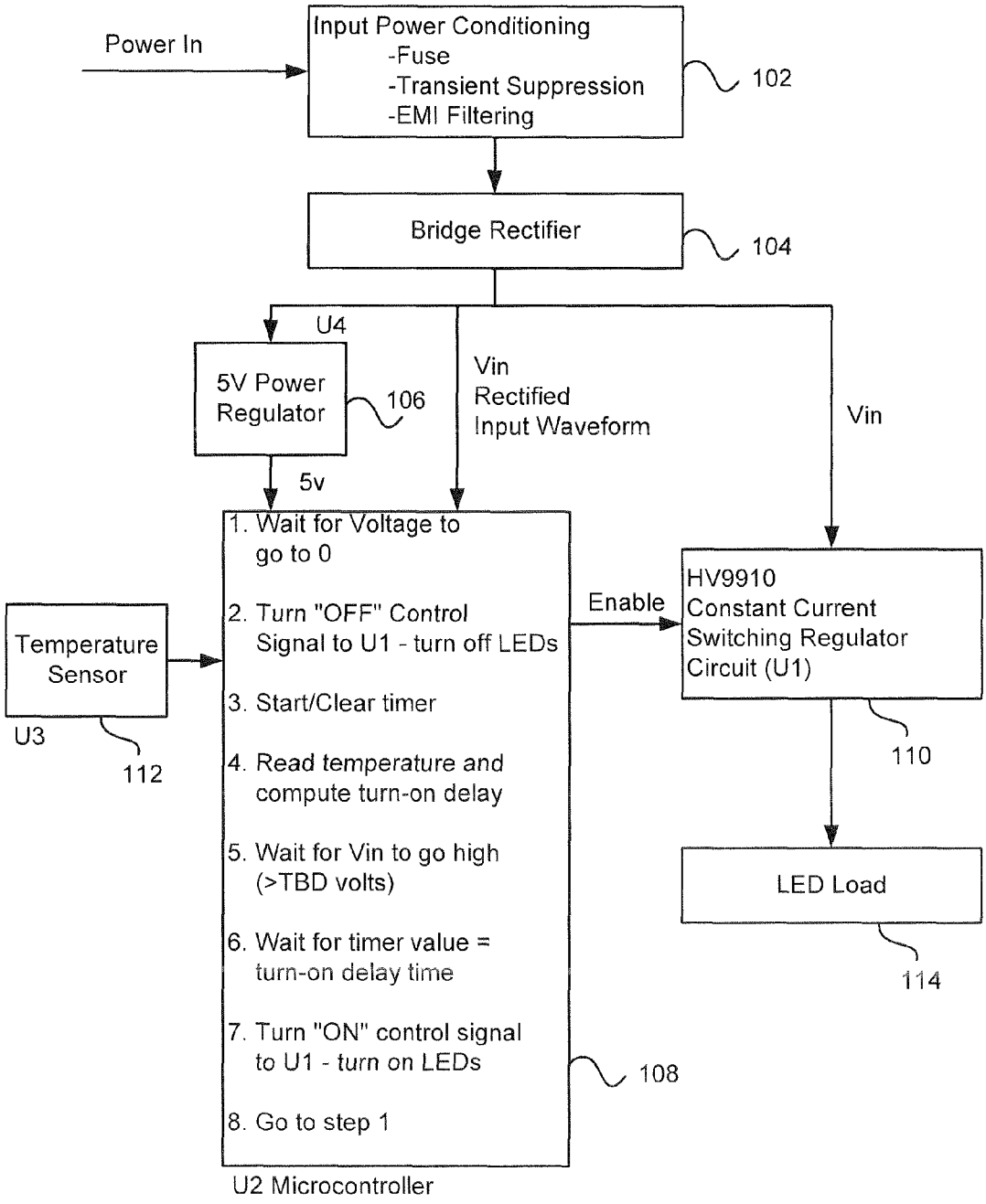
FIG. 2 is a functional block diagram of the dimmable LED driver operation.

Referring to FIG. 1, an embodiment of a dimmable LED driver 100 of the present disclosure is shown. FIG. 2 provides a functional block diagram of the operation of the driver circuit 100 shown in FIG. 1.

Generally, the driver circuit 100 includes an input power conditioning section 102, a bridge rectifier 104, a voltage regulator 106, a programmable microcontroller 108 and a constant current switching regulator 110. A temperature sensor 112 is further provided for sensing the temperature of the driver circuit. The driver circuit 100 is coupled to and will drive LED load 114, i.e., at least one LED.

Figure 3:
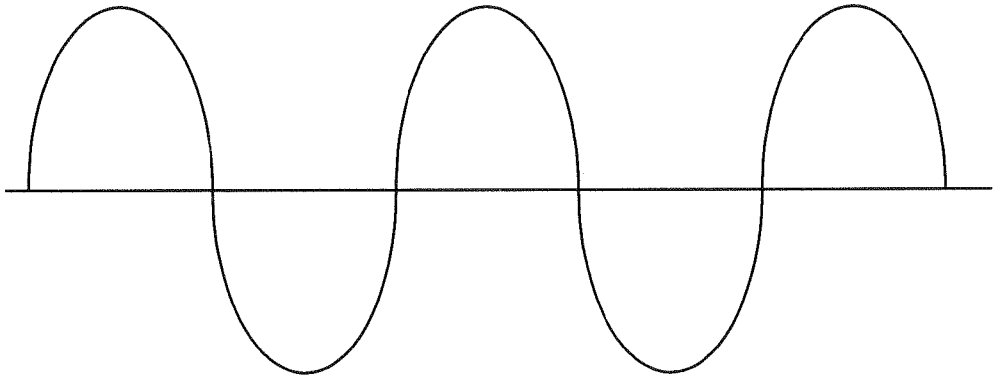
FIG. 3 illustrates an input power waveform.

An input power waveform is illustrated in FIG. 3. The input power conditioning section 102 of the driver circuit provides a protection fuse F1 (2 A, 250V) and a surge suppressor (TS1) to protect against input voltage spikes. The remaining part of input power conditioning section 102 contains an RLC filter and common mode choke (L1) to support EMI filtering to FCC Class A and B conducted and radiated emission limits.

Figure 4:
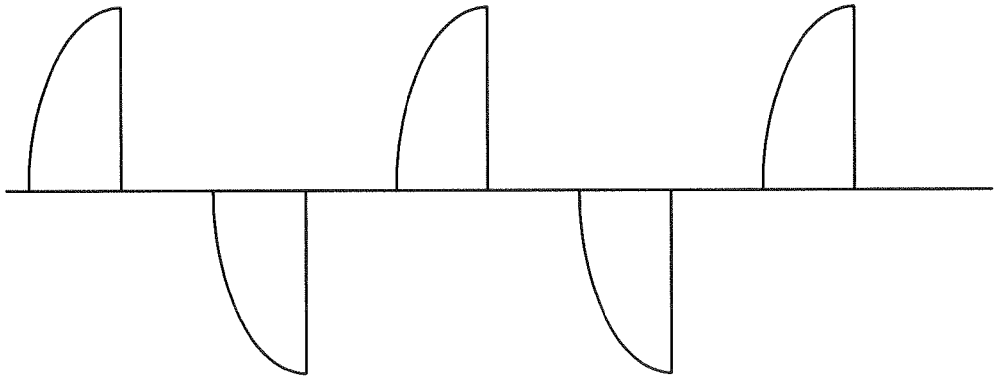
FIG. 4 illustrates the input power waveform after passing through a trailing edge dimmer at approximately 50% dimming level.
Figure 5:
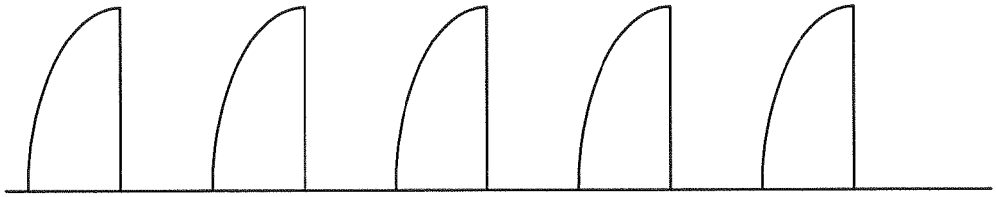
FIG. 5 illustrates the power waveform after being rectified by the driver circuit according to an embodiment of the present disclosure.

FIG. 4 illustrates the input power waveform coming from a trailing edge phase control dimmer set to approximately 50%. The output from the dimmer, i.e., the input power waveform shown in FIG. 4, is coupled to terminals P1 and P2 of the input power conditioning section 102. After the input power conditioning section 102 of the driver circuit, the input power waveform is rectified by a diode bridge (D1) 104. The output of this bridge rectifier 104 is the rectified Voltage—in (Vin) (also illustrated in FIG. 5) utilized by the LED constant current switching regulator 110, voltage regulator 106 and programmable microcontroller 108.

In one exemplary embodiment, the constant current switching regulator circuit 110 uses a Supertex HV9910 (U1) architecture intended to drive up to 5 high power LEDs (e.g. Cree XRE's) at approximately 700 mA from 120 VAC input power. The constant current switching regulator circuit 110, e.g., Supertex HV9910 (U1), has an enable pin (PWMD) that is controlled by the programmable microcontroller 108 so that LED constant current is only generated when required energy is available and in accordance with dimming waveform conditions. The programmable microcontroller 108 will also use this signal to further truncate the LED constant current "on" time if necessary for thermal management purposes.

The driver circuit 100 is designed to provide dimming control by using the programmable microcontroller 108, e.g., a Microchip PIC12F683, to detect the presence and absence of adequate input voltage (caused by the dimmer) and commanding off the current to the constant current switching regulator circuit 110. The voltage thresholds are set in software. FIG. 2 provides a description of the software logic.

The microcontroller 108 monitors the input voltage to the driver/controller 100. This monitoring point is of the voltage waveform (Vin) after the power conditioning of section 102 and bridge rectifier 104. If there is no dimmer in the circuit, Vin will be a rectified form of a standard 60 Hz input waveform. If there is a trailing edge type dimmer in the circuit, Vin will follow a truncated waveform, an example of which is show in FIG. 5. The microcontroller 108 monitors when the dimmer shuts down the input power and goes to "0" voltage (or a value close to it) (Step 1). When the microcontroller 108 senses this trailing edge voltage drop, it turns off the PWMD control signal to the constant current switch regulator 110, which in turn, shuts down current flow to the LED load 114 (Step 2).

When the microcontroller 108 turns off the PWMD signal, it restarts a timer that is used to compute a "turn-on delay" if necessary for temperature compensation (Step 3). After the timer starts running, the microcontroller 108 reads the temperature from the temperature sensor 112 and computes a turn-on delay (Step 4). If it reads 85 degrees C. or higher, it sets the turn-on delay time based on the temperature. It is to be appreciated that the temperature setpoint or threshold used to determine when to turn on the delay adjustable and 85 degrees C. is but one non-limiting example. It is to be further appreciated that the time delay may be calculate by a time delay module disposed with the microcontroller 108 or by a time delay module external to and coupled to the microcontroller 108.

The microcontroller 108 continues to monitor voltage Vin to determine when to turn-on the PWMD signal to the constant current switching regulator 110 (Step 5). When the voltage raises to 5V (or other pre-programmed trigger point), the microcontroller 108 determines if there is a turn-on delay required (Step 6). If "yes", it waits this time period and then sets the PWMD signal to "on" state which causes constant current to be switched on to the LED load 114 (Step 7). If there is no turn-on delay required, the PWMD signal is immediately set to "on" when the Vin value exceeds the 5V or other pre-programmed threshold.

This logic is repeated at a periodic rate following the input voltage frequency (e.g. 120 Hz rectified) (Step 8).

The temperature sensor (U3) 112 is used to measure the driver PCB (printed circuit board) temperature and is polled by the microcontroller 108 at approximately 120 hz. In one embodiment, when the temperature goes over 85 degrees C., the microprocessor 108 slowly increases the turn-on delay time so the constant current switching regulator 110 "on time" is reduced to 70% of what its normal on time would have been. This process is done "slowly" over many seconds so that it is imperceptible to a person using the light fixture. When the temperature decreases below 85 degrees C., the microprocessor 108 slowly decreases the turn-on delay time so that the system goes back to full "on time". The threshold temperature may be changed via software programming depending on the type of light fixture that the LED engine is targeted for. Other thresholding schemes are possible, for example, additional temperature thresholds can be programmed in to further reduce effective "on time" to reduce heat or the LED engine could be completely shut down if a certain maximum temperature is exceeded.

In another embodiment of the present disclosure, a constant current driver circuit for a transformer based LED system is provided. Typically, a transformer based LED system employs a magnetic or electronic transformer. A magnetic transformer may use a traditional laminated core or be of toroidal type. These magnetic transformer devices have electrical characteristics of inductance and resistance, which comes into play when considering dimmer types and LED driver design. An electronic transformer is based on a high frequency (e.g. 30 kHz) switching regulator circuit that synthesizes a low voltage waveform from the high voltage waveform. The electronic transformer has reactive load (inductance, capacitance, resistance) characteristics which also affects dimmer types to be used and LED driver design.

Therefore, the constant current drive of this embodiment takes into account at least the following system issues: current symmetry after the dimmer so there is no, or minimal DC offset component which could damage the magnetic transformer; load present when the dimmer is shutting down for consistent phase-to-phase operation (which can otherwise cause flicker); ability for the dimmer to function with very low loads (e.g. 6 watts); RC time constant within the dimmer can be affected by resistance in the transformer and drive circuits (i.e., cause flicker); dimmers have EMI filter components which can interact with the transformer and LED driver and cause instabilities (flickering); smooth, linear operation from maximum to minimum dim settings; unstable supply voltage to the LED driver at higher levels of dimming, i.e., must ensure driver works in stable manner, phase-to-phase (no flicker); and LED non-linearity, i.e., LED driver should provide constant current to achieve desired light output and power levels.

Figure 6:
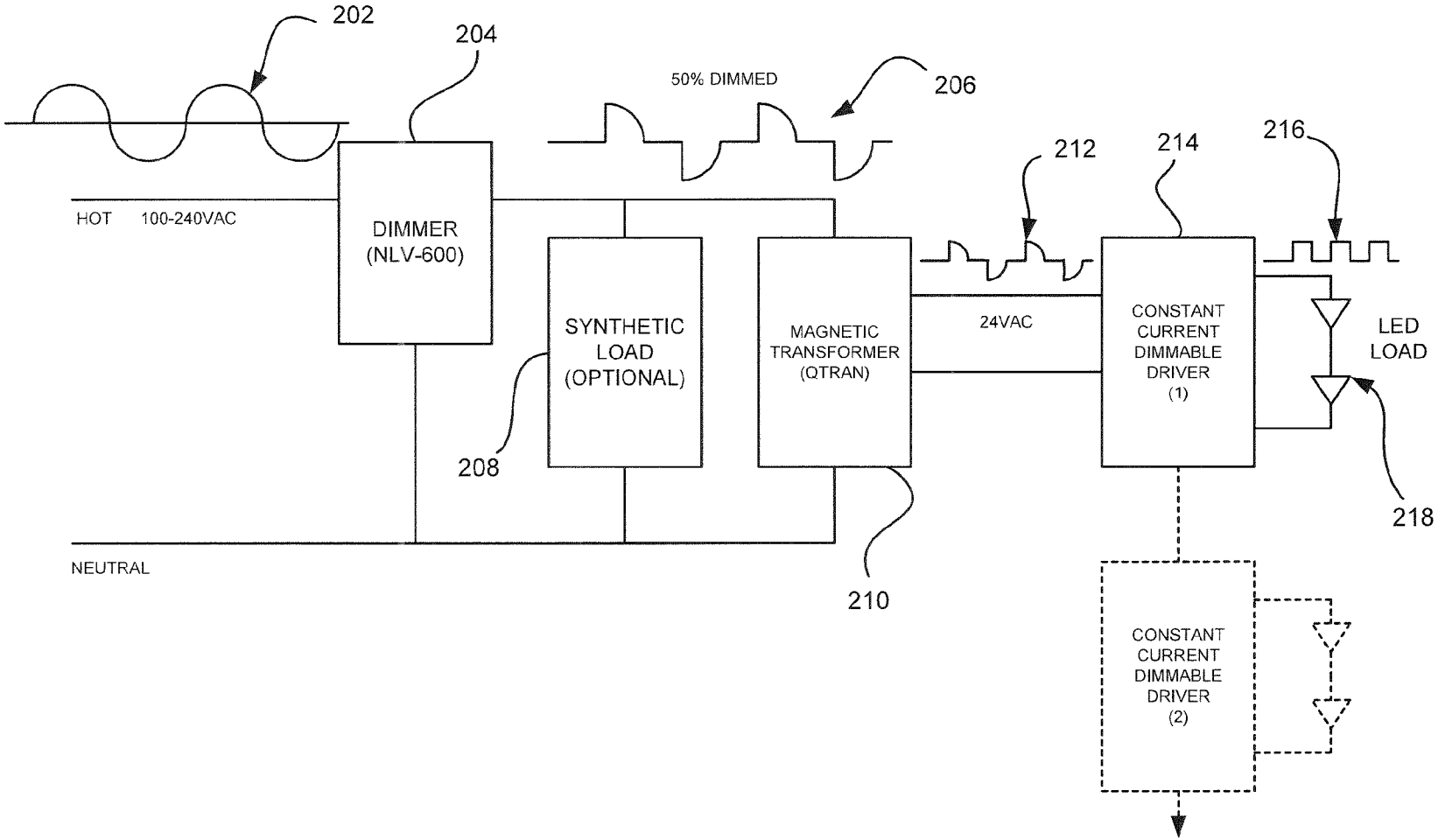
FIG. 6 is a block diagram of a magnetic transformer based dimmable LED system.

FIG. 6 is a diagram of a magnetic transformer based LED system of which the techniques of the present disclosure are incorporated to drive an LED load. The magnetic transformer based LED system includes a standard magnetic transformer 210, a three wire MLV type standard triac dimmer 204, an optional synthetic load 208, an LED driver circuit 214 and the LED load 218. The input power waveform 202 is modified by a Triac type MLV dimmer 204. An exemplary dimmer type is the Lutron Nova NLV-600 though other dimmers may be used. This dimmer is a forward phase dimmer which will produce the power waveform 206, when the dimmer control is set to its approximate 50% setting. A synthetic load box 208 (e.g., Lutron LUT-LBX) provides an additional load to the dimmer to help insure consistent operation of the Triac circuit in the dimmer. A magnetic transformer 210 (e.g. Qtran 100 W toroidal) reduces the line voltage input to a 24 VAC waveform 212. The LED Driver 214 converts this input AC waveform to a constant current pulsed waveform 216 to the LED load 218, the duty cycle of which is directly proportional to the dimming level.

Figure 7:
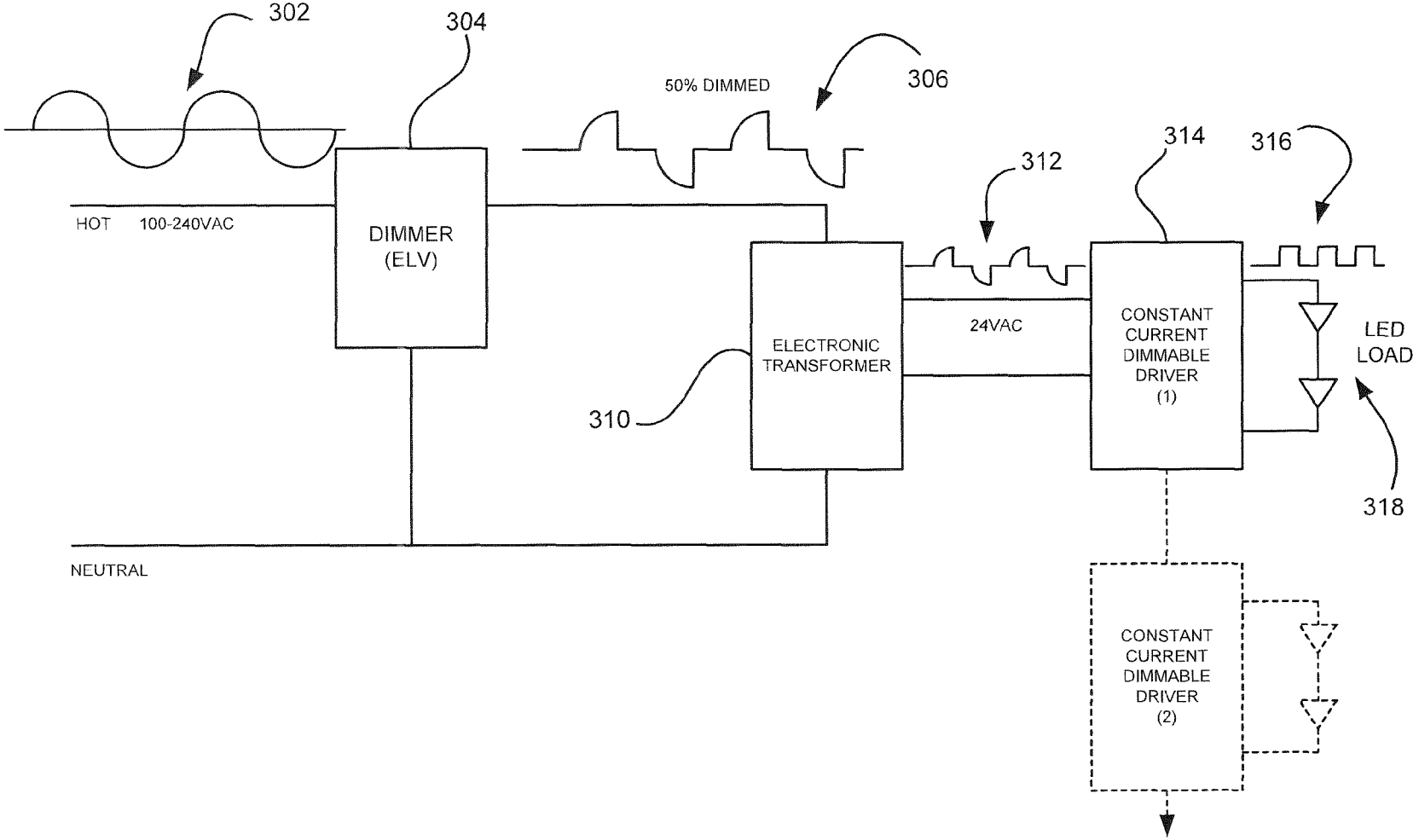
FIG. 7 is a block diagram of an electronic transformer based LED system.

FIG. 7 is a diagram of an electronic transformer based LED system of which the techniques of the present disclosure are incorporated to drive the LED load. The electronic transformer based LED system includes an electronic transformer 310, a three wire ELV type standard dimmer 304, an LED Driver circuit 314 and the LED load. The input power waveform 302 is modified by the ELV dimmer 304. An exemplary dimmer type is the Lutron Diva ELV-300P though other ELV type dimmers may be used. This dimmer is a reverse phase (i.e., "trailing edge") dimmer which will produce the power waveform 306, when the dimmer control is set to its approximate 50% setting. An electronic transformer 310 (Hatch RS24-60M)) reduces the higher voltage input to a 24 VAC waveform 312. The LED driver 314 converts this input AC waveform to a constant current pulsed waveform 316 to the LED load 318, the duty cycle of which is directly proportional to the dimming level.

Figure 8:
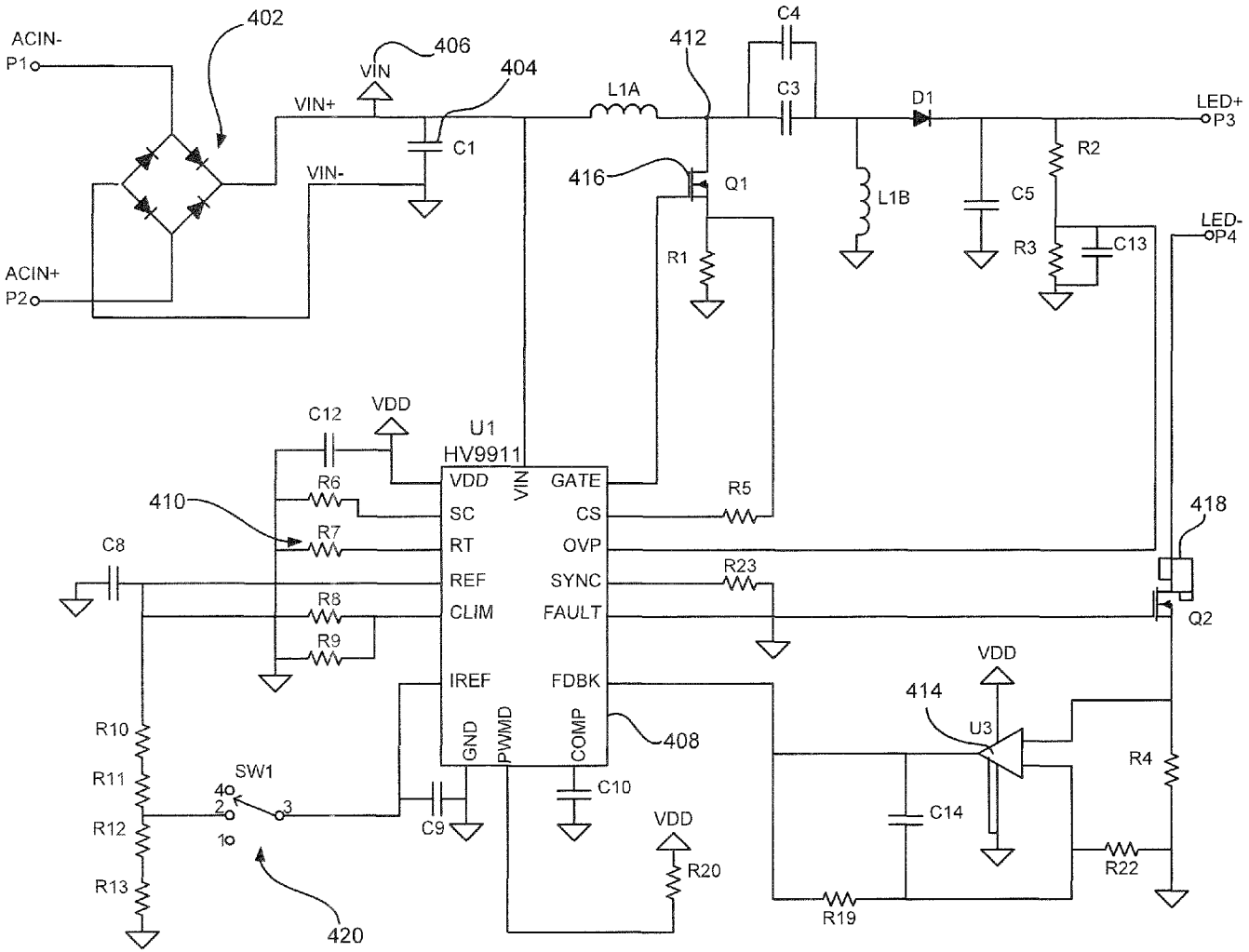
FIG. 8 is a schematic diagram of a dimmable LED driver circuit employed in the systems of FIGS. 6 and 7 in accordance with another embodiment of the present disclosure.

FIG. 8 illustrates an LED driver circuit to be employed in a transformer based LED system in accordance with the present disclosure.

A input rectifier full wave bridge 402 converts the input AC voltage to pulsating DC voltage. The bridge 402 is constructed with Schottky diodes. Schottky diodes are required to minimize diode reverse recovery time, to minimize EMI, and to maximize efficiency. The low forward diode voltage drops of Schottky diodes versus conventional diodes increase efficiency. The Schottky diodes are also required for operation with an electronic transformer. The electronic transformer modulates the low frequency AC input voltage (typically 60 Hz) at high frequency (typically 25 KHz to 40 KHz) carrier. The high frequency modulation allows the use of much smaller magnetics. The high frequency modulation would cause excessive power dissipation and EMI with a conventional diode bridge. Capacitor C1 404 reduces high frequency transients and EMI at the output of the bridge Vin 406. Thus, Vin 406 will be the same whether the bridge is driven by a magnetic transformer or an electronic transformer.

The current mode control LED driver is designed to control single switch PWM (pulse width modulation) converters (e.g. SEPIC circuit design) in a constant frequency mode. Resistor R7 410 controls the time period of the PWM. The configuration is a single ended primary inductance converter (SEPIC) configuration. The SEPIC configuration enables the LED load to be driven when the pulsating DC input voltage level is either below or above the voltage of the LED load. Although a SEPIC configuration is shown and described, it is to be appreciated that a buck or a boost configuration is within the scope of the present disclosure and can be achieve with minor modifications.

The operation of the regulator 408, e.g., a Supertex HV9911 U1, switches On and Off with the level of the pulsating DC input (Vin). The On time is controlled by the dimmer setting. The lower the dimmer setting the shorter regulator 408 is On. The regulator 408 produces a constant current drive while it is On. Thus, the dimmer setting produces a linear change average current in the LED load. The dimmer switches On and Off on each half cycle of the input waveform (typically 120 Hz). The human eye can not distinguish the 120 Hz pulsation, only the change in average light output.

The firing point of the dimmer is not normally symmetric on the positive and negative half cycles of the AC input. This unbalance can cause different levels of current to be delivered from the positive and negative half cycles after being changed to pulsating DC by the bridge 402. This is especially true at a low dimmer setting. The effect causes a net DC current in the transformer of FIGS. 6 and 7. A DC current in the transformer can cause saturation which can lead to LED flicker, and transformer overheating. In the magnetic transformer configuration (see FIG. 6), a synthetic load 208 is used to keep the dimmer transition points symmetric. In the case of the electronic transformer (see FIG. 7), the unbalance load is transmitted through the transformer at a high frequency (typically 25 KHz to 40 KHz). Since the load unbalance is at a low frequency compared to the electronic transformer switching frequency the load appears to be symmetric to the magnetics in the electronic transformer. Thus, no synthetic load is necessary. Flicker free performance occurs without transformer saturation and without excess transformer self-heating.

The components that form the SEPIC configuration in FIG. 8 are inductor L1A, FET switch Q1, capacitors C3 and C4, inductor L1B, diode D1, and capacitor C5. Capacitors C3 and C4 are in parallel and will be referred to as C3-4. When the FET switch Q1 is On, C3-4 is connected in parallel with inductor L1B. The voltage across inductor L1B is thus equal to the voltage across C3-4 and equal to Vin. Diode D1 is reverse biased and the load current is being supplied by capacitor C5. During this period, energy is being stored in inductor L1A from the input and in inductor L1B from C3-4. During the FET switch Off time, the current in inductor L1A continues to flow through C3-4, diode D1, and into capacitor C5 and the load, recharging C3-4 to make it ready for the next cycle. The current in inductor L1B also flows into capacitor C5 and the load, ensuring the capacitor C5 is recharged and ready for the next cycle. During this period, the voltage across inductor L1A and inductor L1B is equal to voltage Vout. The voltage across C3-4 is equal to Vin and the voltage on inductor L1B is equal to Vout. To meet these criteria, the voltage at the node 412 of inductor L1A and C3-4 must be Vin+Vout. The voltage across inductor L1A=(Vin+Vout)−Vin=Vout. The SEPIC configuration allows inductors L1A and L1B to be a coupled inductor. This allows much smaller magnetics to be used. The coupled inductor reduces the required inductance by a factor of 2.

The current in the LED load is sense by the voltage across resistor R4. Operational amplifier (U3) 414 and the gain resistors R19 and R22 amplify the signal across resistor R4. The use of a low level signal across resistor R4 and the amplifier 414 minimizes the power dissipation necessary to produce the current feedback signal necessary for regulator 408.

Resistor R1 sets the current limit for the FET switch (Q1) 416. The voltage across resistor R1 is sensed by the regulator 408. The regulator 408 has two thresholds. The lower threshold sets the current limit for FET switch (Q1) 416. The upper threshold sets the current limit for a short circuit fault condition. Another fault condition is caused by excess voltage at Vout. This would be cause by the removal of the LED load. This fault condition is detected by sensing the Vout voltage through components R2, R3, and C13. FET switch (Q2) 418 is turned OFF during a fault. FET switch (Q2) 418 is ON under normal operating conditions. The fault is reset each time the Vin falls below 6 V. This occurs twice a cycle of the input AC input power which is normally 120 times per second. Thus, if a momentary fault occurs it will be cleared soon after the fault dissipates and normal operation will resume.

The LED driver and SEPIC configuration sets a constant current in the LED load when Vin is above 7.2V. The level of the constant current is controlled by the voltage on regulator 408 pin 15. A voltage divider and switch (SW1) 420 set 3 predetermined current levels. The switch 420 is available to the end user. Thus the current level is selectable at installation. This current level and thus the light output is modulated by the dimmer setting as explained above.

While the disclosure has been shown and described with reference to certain preferred embodiments thereof, it will be understood by those skilled in the art that various changes in form and detail may be made therein without departing from the spirit and scope of the disclosure.

What is claimed is:

1. A current driver circuit for at least one light emitting diode (LED) comprising:

an input section adapted to receive a truncated power waveform generated by a variable dimmer circuit, the truncated power waveform having a positive pulse portion and a negative pulse portion, a duty cycle of which is proportional to a desired dimming level;

a rectifier section for rectifying the input truncated power waveform to a plurality of positive pulses;

a current switching regulator adapted to provide a constant current to the at least one LED; and a controller coupled to the rectifier section and adapted to determine a level of each of the plurality of positive pulses, wherein if the level is below a first predetermined threshold, the current switching regulator is turned off by the controller and, if the level is a above a second predetermined threshold, the current switching regulator is turned on by the controller so as to pulse modulate the constant current to the at least one LED to maintain the desired dimming level of the at least one LED.

2. The current driver circuit as in claim 1, further comprising a time delay module adapted to delay the turning on of the current switching regulator for a predetermined period of time after the current switching regulator has been turned off.

3. The current driver circuit as in claim 2, further comprising a temperature sensor adapted to measure a temperature of the current driver circuit, wherein the predetermined period of time for delay is based on the measured temperature.

4. The current driver circuit as in claim 3, wherein the current switching regulator provides the constant current via a pulse width modulated (PWM) signal.

5. The current driver circuit as in claim 4, wherein an on time of the PWM signal is based on the measured temperature.

6. The current driver circuit as in claim 4, wherein an on time of the PWM signal is decreased when the measured temperature is above a predetermined temperature threshold.

7. The current driver circuit as in claim 3, wherein the rectifier section is a diode bridge.

* * * * *